US009410760B2

(12) United States Patent
Siddle

(10) Patent No.: US 9,410,760 B2
(45) Date of Patent: Aug. 9, 2016

(54) SEAR ASSEMBLY FOR HAMMERLESS, STRIKER FIRED HANDGUN

(71) Applicant: Double Nickel Holdings, LLC, Millstadt, IL (US)

(72) Inventor: Kevin Siddle, Millstadt, IL (US)

(73) Assignee: Double Nickel Holdings, LLC, Millstadt, IL (US)

( * ) Notice: Subject to any disclaimer, the term of this patent is extended or adjusted under 35 U.S.C. 154(b) by 0 days.

(21) Appl. No.: 14/813,402

(22) Filed: Jul. 30, 2015

(65) Prior Publication Data

US 2016/0084600 A1 Mar. 24, 2016

Related U.S. Application Data

(63) Continuation-in-part of application No. 29/499,396, filed on Aug. 14, 2014, now Pat. No. Des. 746,402.

(60) Provisional application No. 62/030,814, filed on Jul. 30, 2014.

(51) Int. Cl.
*F41A 19/00* (2006.01)
*F41A 19/12* (2006.01)

(52) U.S. Cl.
CPC ..... *F41A 19/12* (2013.01)

(58) Field of Classification Search
CPC ..... F41A 19/12; F41A 19/10; F41A 19/16; F41A 19/31; F41A 17/46
USPC ..... 42/69.01
See application file for complete search history.

(56) References Cited

U.S. PATENT DOCUMENTS

| | | | | | |
|---|---|---|---|---|---|
| 1,403,133 | A | * | 1/1922 | Stokke | F41A 15/12 42/25 |
| 2,618,878 | A | | 11/1952 | Mulno | |
| 3,397,474 | A | | 8/1968 | Badali | |
| 3,503,149 | A | * | 3/1970 | Hedges | F41A 17/74 42/65 |
| 3,857,322 | A | * | 12/1974 | Lichtman | F41A 3/82 42/15 |
| 3,949,509 | A | | 4/1976 | Larsson | |
| 4,275,640 | A | | 6/1981 | Wilhelm | |
| 4,555,861 | A | | 12/1985 | Khoury | |
| H000144 | H | | 10/1986 | Savioli | |
| 4,825,744 | A | | 5/1989 | Glock | |
| 5,050,480 | A | | 9/1991 | Knight et al. | |
| 5,157,209 | A | | 10/1992 | Dunn | |
| 5,166,458 | A | | 11/1992 | Yoo | |
| 5,245,776 | A | * | 9/1993 | Dornaus | F41A 17/72 42/144 |
| 5,386,659 | A | | 2/1995 | Vaid et al. | |
| 5,697,178 | A | * | 12/1997 | Haskell | F41A 17/58 42/70.04 |
| 5,701,698 | A | | 12/1997 | Wesp et al. | |
| 5,822,903 | A | | 10/1998 | Davis, Sr. | |

(Continued)

*Primary Examiner* — Michael David
(74) *Attorney, Agent, or Firm* — Thompson Coburn LLP

(57) ABSTRACT

A sear assembly includes a sear block with a cavity configured to receive at least part of and at least one of a sear pivot, sear lever, sear catch and disconnector. The cavity has a slot with the sear catch configured for reciprocating sliding motion in the slot between a first position in which the sear catch engages a firing pin and a second position in which the sear catch disengages from the firing pin. The sear lever and sear pivot are configured for pivoting motion in the cavity. The sear lever is operatively connected to the sear catch. The disconnector is configured to engage the sear pivot and effect movement of the sear catch from the first position to the second position and to disengage from the sear pivot to allow movement of the sear catch from the second position to the first position.

20 Claims, 8 Drawing Sheets

(56) References Cited

U.S. PATENT DOCUMENTS

| | | | | |
|---|---|---|---|---|
| 5,906,066 | A | 5/1999 | Felk | |
| 5,915,934 | A | 6/1999 | Knight et al. | |
| 5,939,657 | A * | 8/1999 | Morgado | F41A 9/45 42/9 |
| 6,283,006 | B1 | 9/2001 | Szabo et al. | |
| 6,347,474 | B1 | 2/2002 | Wolff, Jr. | |
| 6,560,909 | B2 | 5/2003 | Cominolli | |
| 7,194,833 | B1 * | 3/2007 | Curry | F41A 19/12 42/14 |
| 7,617,628 | B2 | 11/2009 | Curry | |
| 8,220,193 | B1 * | 7/2012 | Lynch | F41A 17/48 42/70.08 |
| 8,720,096 | B2 | 5/2014 | Siddle | |
| 8,931,393 | B1 | 1/2015 | Vincent et al. | |
| 8,966,802 | B1 | 3/2015 | Findlay | |
| 9,046,313 | B1 | 6/2015 | Lutton et al. | |
| 9,194,639 | B1 * | 11/2015 | Malheiros | F41A 19/32 |
| D746,402 | S * | 12/2015 | Siddle | D22/108 |
| 9,222,745 | B2 * | 12/2015 | Kallio | F41A 17/72 |
| 2010/0175292 | A1 | 7/2010 | Young | |
| 2011/0041680 | A1 | 2/2011 | Smirnov | |
| 2012/0096753 | A1 | 4/2012 | Pichler | |
| 2012/0117841 | A1 | 5/2012 | Joubert et al. | |
| 2012/0117842 | A1 | 5/2012 | Popikov | |
| 2013/0133237 | A1 * | 5/2013 | Domian | F41A 17/36 42/70.02 |
| 2013/0180394 | A1 * | 7/2013 | Siddle | F41A 19/29 89/132 |
| 2014/0246003 | A1 | 9/2014 | Lipowski | |

* cited by examiner

SEAR ASSEMBLY FOR HAMMERLESS, STRIKER FIRED HANDGUN

CROSS-REFERENCE TO RELATED APPLICATION

This application claims the benefit of provisional application Ser. No. 62/030,814, filed on Jul. 30, 2014, the disclosure of which is incorporated by reference herein. This application is a continuation in part of application Ser. No. 29/499,396, filed Aug. 14, 2014, currently pending, the disclosure of which is incorporated by reference herein.

BACKGROUND

A hammerless, striker fired model 1911 handgun and associated methods is disclosed in U.S. Pat. No. 8,720,096, the disclosure of which is incorporated herein by reference. This disclosure relates to an improved firing system for such a hand gun. In particular, the firing system is a striker fired mechanism that replaces the pivoting hammer system that actuates the firing pin and uses the remaining components of the handgun. The system may utilize other existing components found on pivoting hammer actuating-type firearms. For instance, as described below in further detail, the sear assembly may be installed in a conventional pivoting hammer actuated-type system and cooperate with an existing trigger mechanism to allow its use. The handgun may be constructed with the disclosed hammerless, striker fired system. In the alternative, the handgun may be retrofitted with the disclosed hammerless, striker fired system replacing the pivoting hammer that ordinarily actuates the firing pin. Such an assembly is shown in co-owned application Ser. No. 29/499,396, the disclosure of which is incorporated herein. Accordingly, this disclosure incorporates methods of modifying existing handguns to incorporate a hammerless, striker fired system.

DETAILED DESCRIPTION

Figure 1:
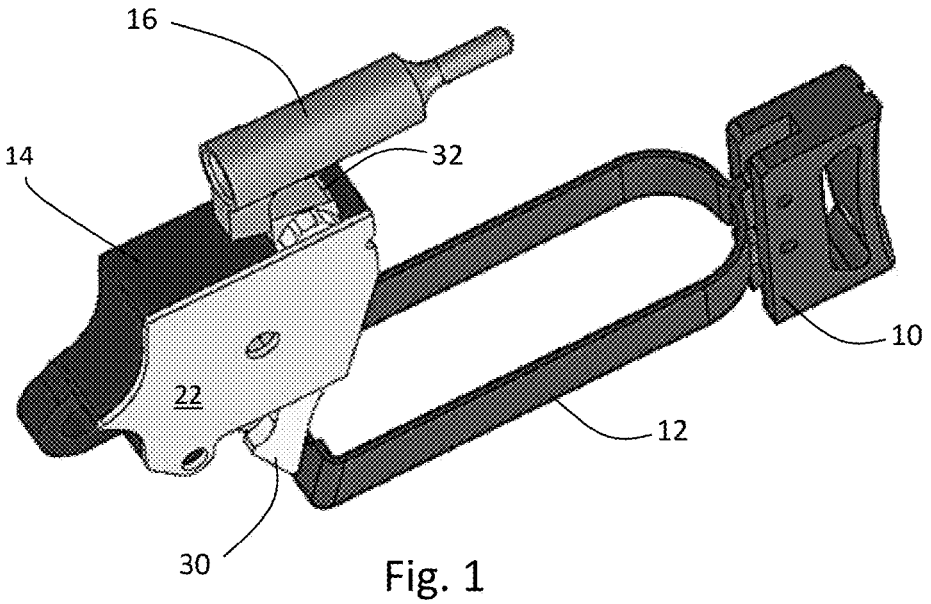
FIG. 1 shows a perspective view of a trigger, trigger bow, sear assembly, and firing pin.
Figure 2:
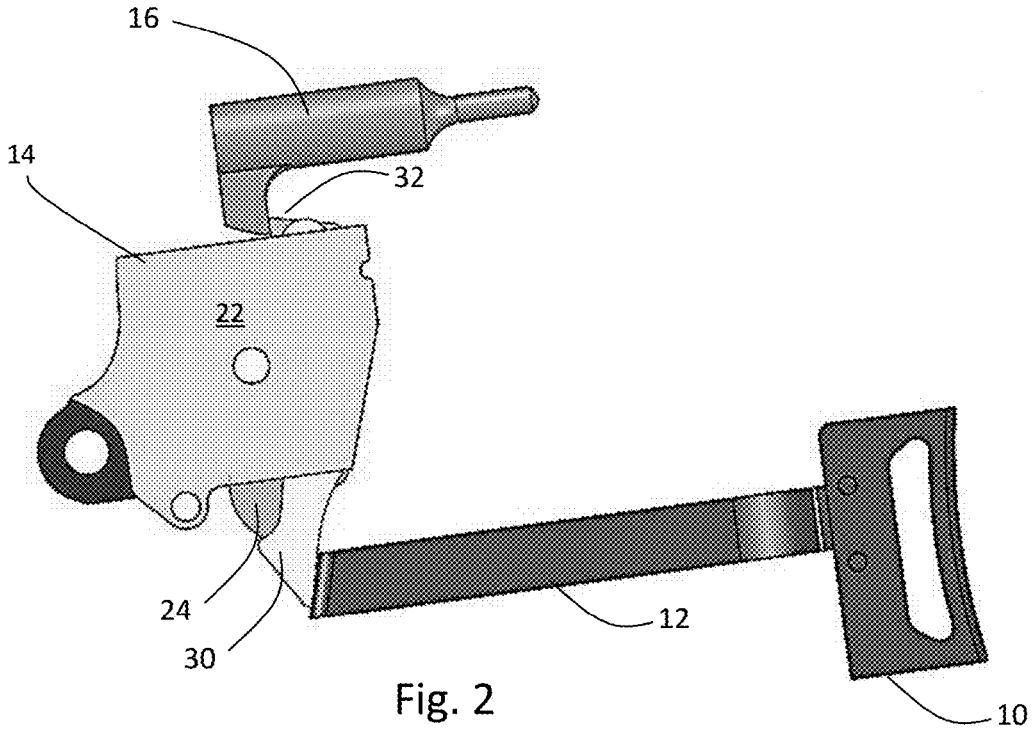
FIG. 2 shows a side elevational view of the components of FIG. 1.
Figure 3:
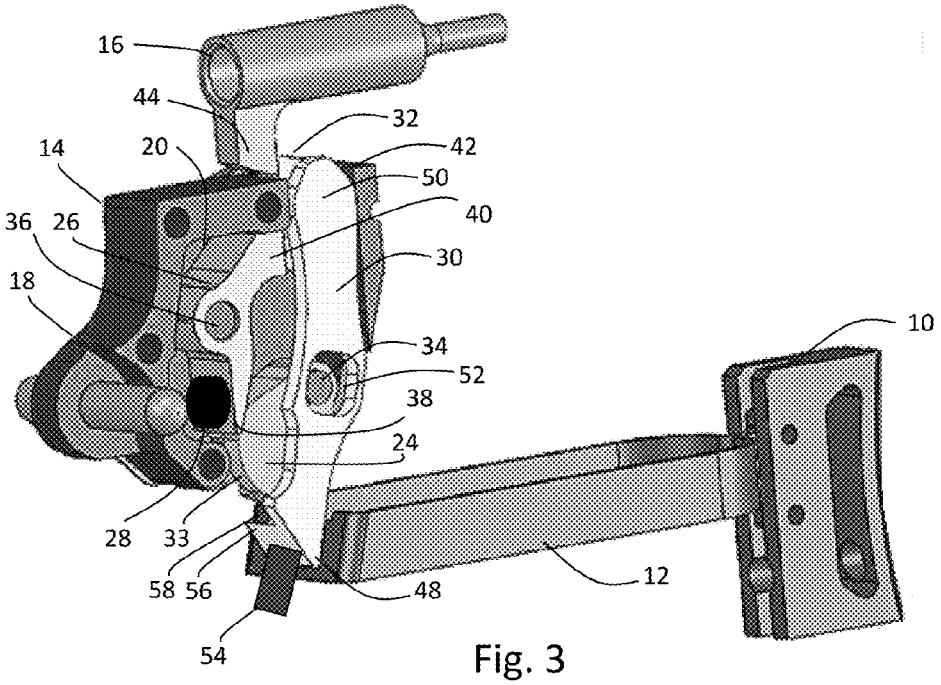
FIG. 3 shows a perspective view of a trigger, trigger bow, sear assembly with a sear cover plate removed to show the internal components of the sear assembly, and a firing pin.
Figure 4:
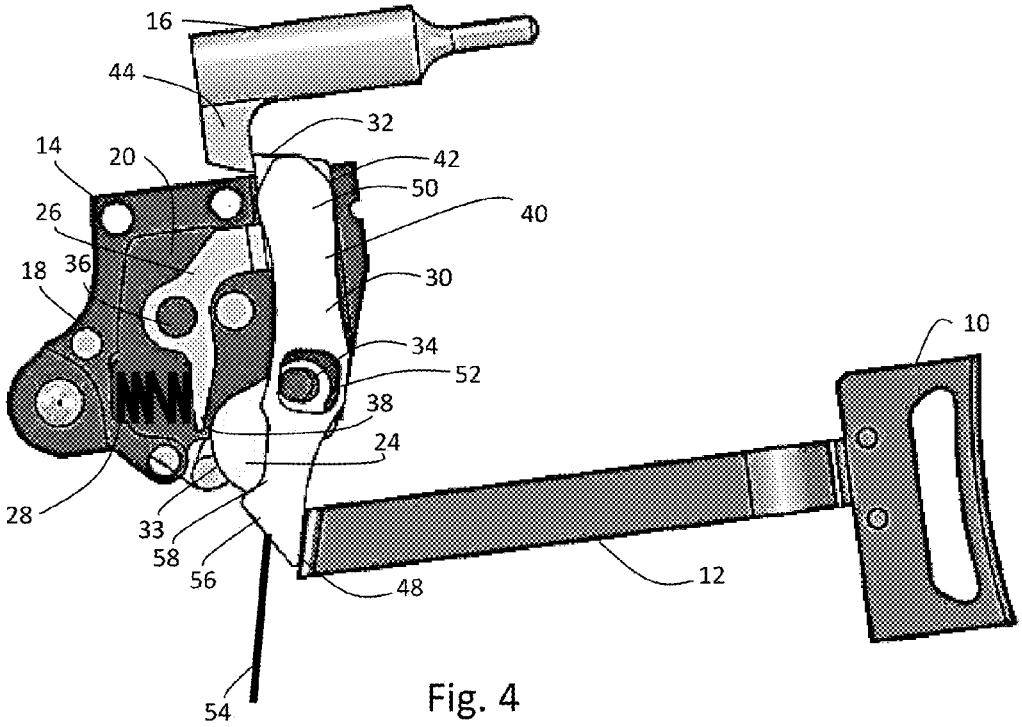
FIG. 4 is a side elevational view similar to FIG. 3.

The terms up, down, left, right, horizontal, and vertical are all used for purposes of ease of illustrating the disclosed embodiments and the relative orientation of the described parts as shown in the drawings. The terms are not intended to limit any disclosed embodiment in any way.

FIG. 1 shows several components of the firing assembly including a trigger 10 connected to a trigger bow 12, a sear assembly 14, and a firing pin 16. The trigger 10 and trigger bow 12 are configured for reciprocating sliding motion in the same plane as the slide of the handgun. The trigger bow 12 actuates the sear assembly 14 to release the firing pin 16 in a manner to enable successive discharging of the handgun upon successive actuation of the trigger of the firearm. In FIGS. 1-6, the trigger 10 and trigger bow 12 move to the left in the drawings to actuate the sear assembly 14 and the firing pin 16.

The sear assembly 14 comprises a block 18 which is dimensioned to fit in an existing handgun frame, for instance, a model 1911 handgun. The sear block 18 has a cavity 20 which receives the components of the sear assembly and a cover 22 may seal the cavity 20 of the sear block 18. The internal components housed in the cavity 20 of the sear block 18 include a sear pivot 24, a sear lever 26, a sear lever spring 28, a disconnector 30, and a sear catch 32.

The sear pivot 24 has a tear drop shape with an outer periphery that forms a cam surface 33. The sear pivot 24 is arranged for pivoting motion within the cavity 20 of the sear block 18. The sear pivot 24 is pivotally connected to a sear pivot pin 34 projecting from the sear cavity 20. The sear pivot 24 has a hole to receive the sear pivot pin 34. The hole in the sear pivot 24 may formed in a lobe offset from a center of sear pivot.

The sear lever 26 is arranged for pivoting motion within the cavity 20 of the sear block 18. The sear lever 26 is pivotally connected to a sear lever pivot pin 36 projecting from the sear cavity 20. The sear lever 26 has a hole to receive the sear lever pivot pin 36. The hole may be generally intermediate first and second ends 38,40 of the sear lever 26. The sear lever second end 40 is operatively connected to the sear catch 32. The sear lever first end 38 may be configured to be in driving engagement with the cam surface 33 of the sear pivot 24. The cam surface 33 of the sear pivot 24 may have a ridge which engages the first end 38 of the sear lever 26 thereby enabling the sear lever to rotate clockwise (in the drawings) in the cavity 20 of the sear block 18. The sear lever spring 28 urges the first end 38 of the sear lever 26 into engagement with the cam surface 33 of the sear pivot 24. In the drawing FIGS. 1-6, the sear lever spring 28 urges the first end 38 of sear lever 26 to the right thereby producing counterclockwise rotation of the sear lever within the cavity of the sear block. The sear lever spring 28 may urge the first end 38 of the sear lever 26 against the sear pivot 24. The sear lever spring 28 may be a flat spring.

Figure 5:
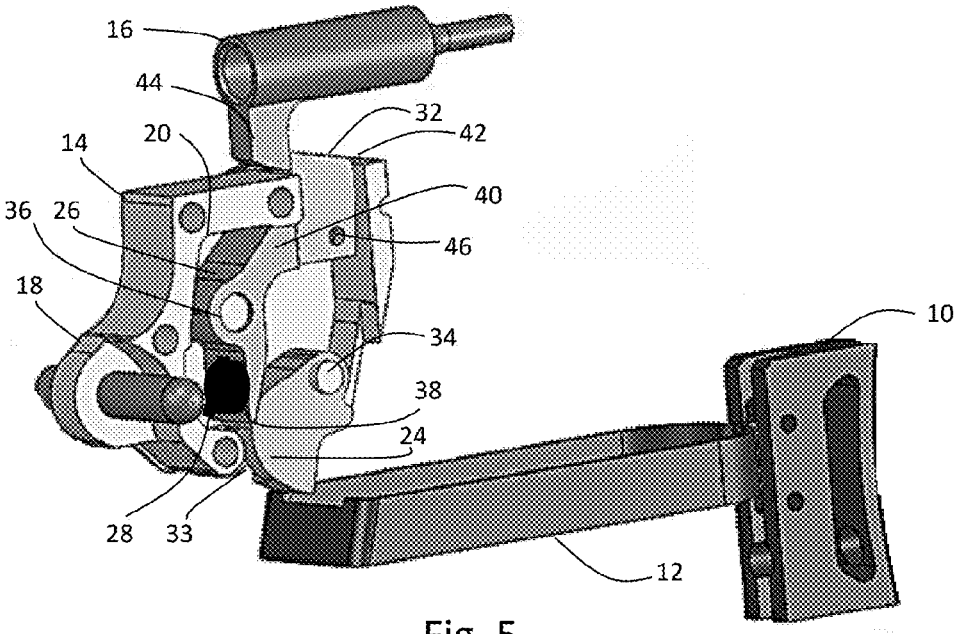
FIG. 5 is a view similar to FIG. 3 with a disconnector member of the sear assembly removed to show additional detail of the components of the sear assembly.
Figure 6:
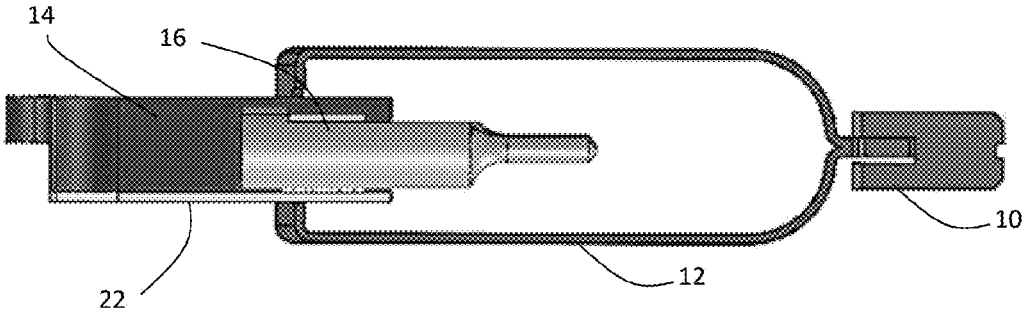
FIG. 6 is a top plan view of the components of FIG. 2.
Figure 7:
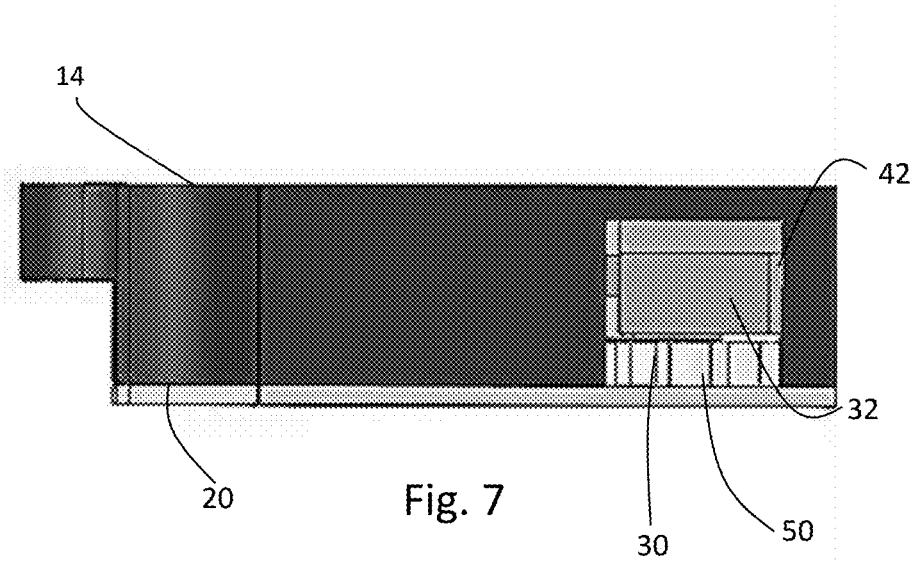
FIG. 7 is a top plan view of the sear assembly of FIG. 2.
Figure 8:
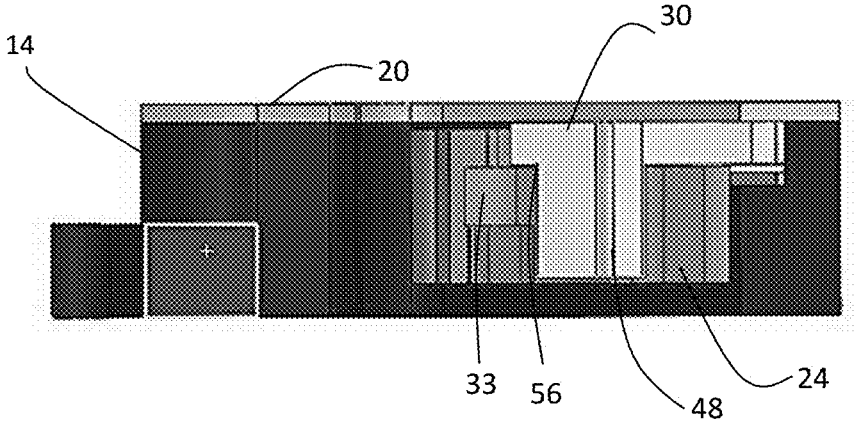
FIG. 8 is a bottom plan view of the sear assembly of FIG. 2.
Figure 9:
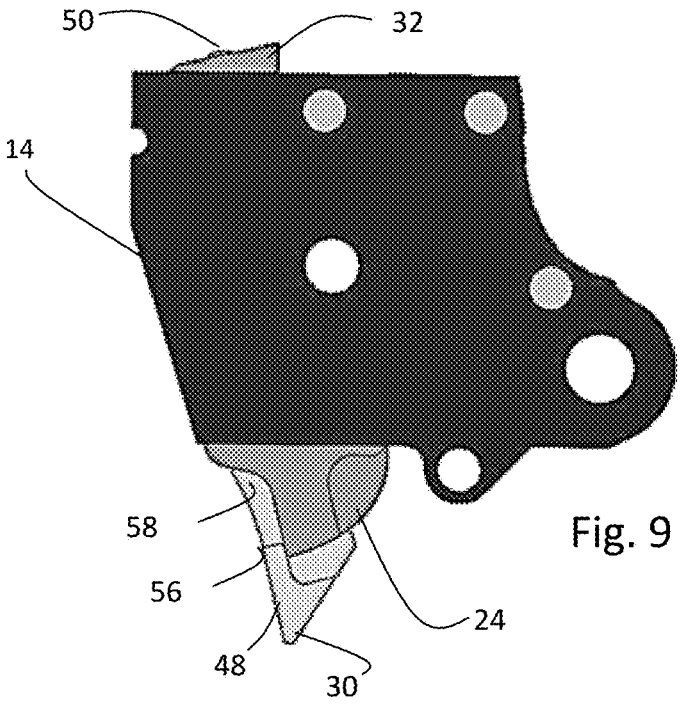
FIG. 9 is a back view of the sear assembly of FIG. 2.
Figure 10:
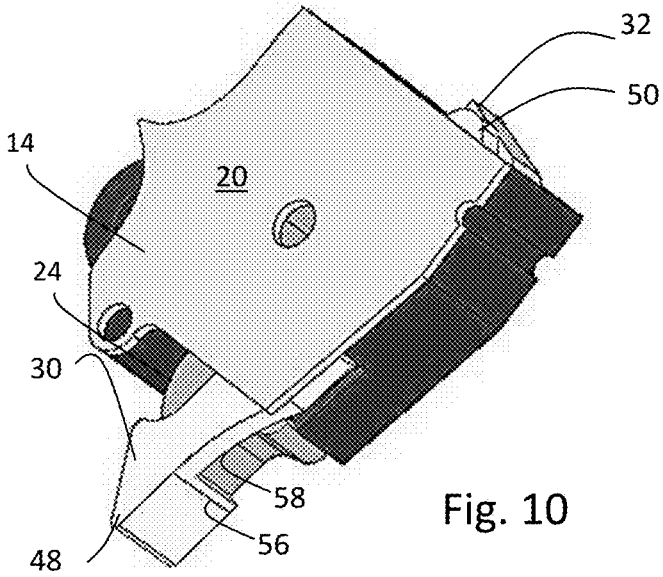
FIG. 10 is a perspective view of the sear assembly of FIG. 2.
Figure 11:
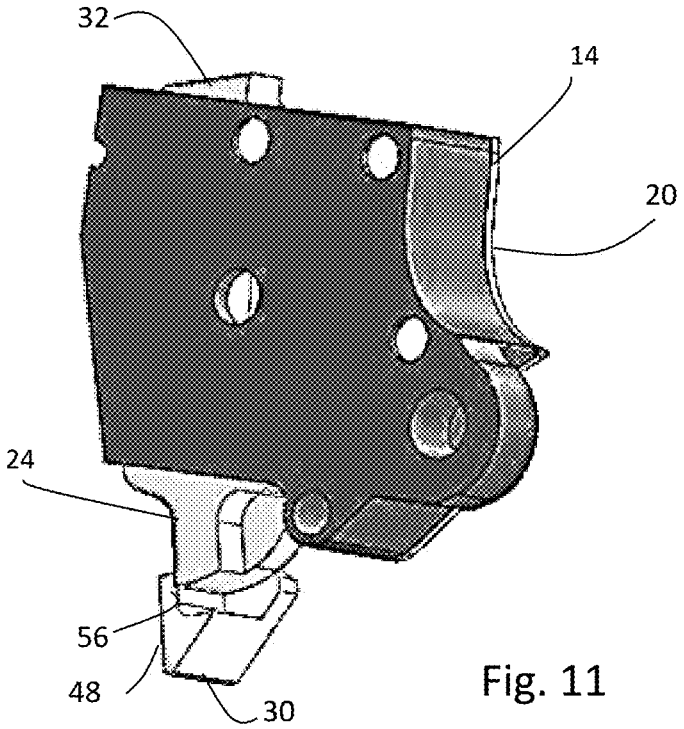
FIG. 11 is an alternate perspective view of the sear assembly of FIG. 2.
Figure 12:
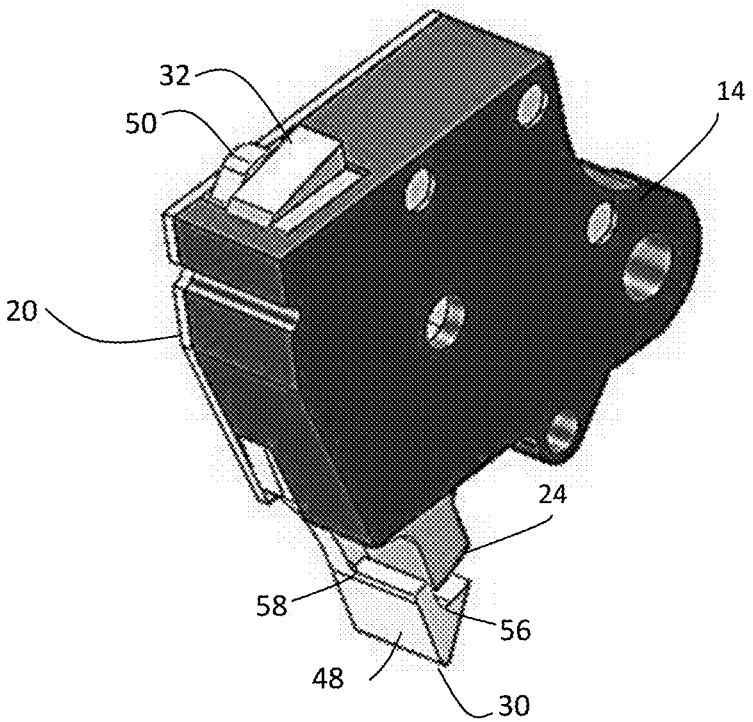
FIG. 12 is an alternate perspective view of the sear assembly of FIG. 2.
Figure 13:
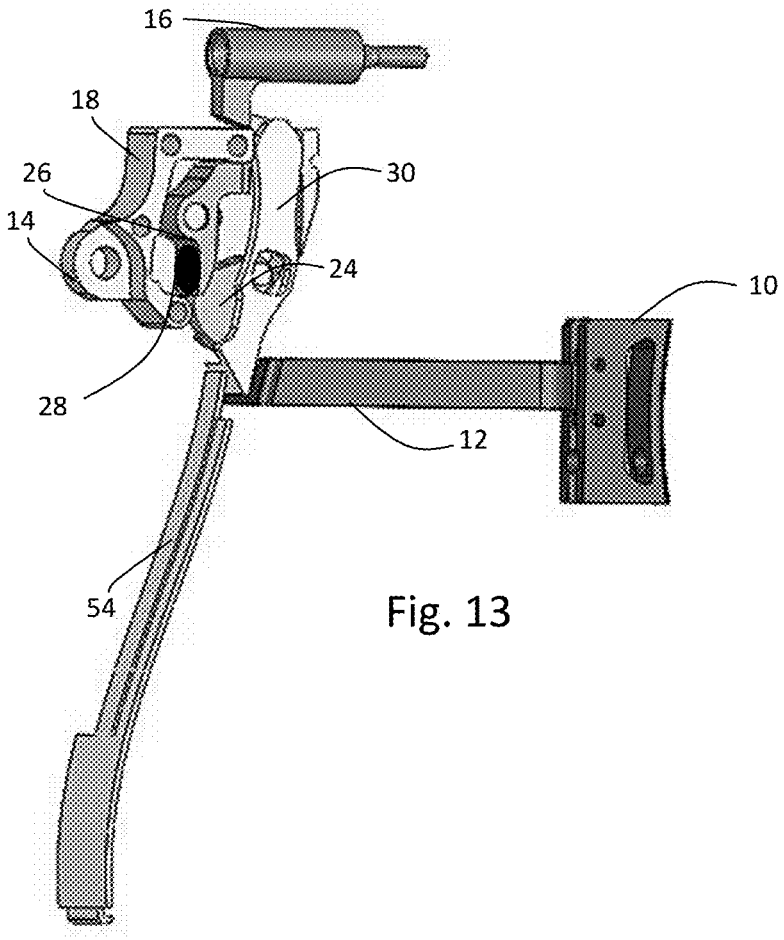
FIG. 13 is a view similar to FIG. 3 showing additional detail of the disconnector flat spring.
Figure 14:
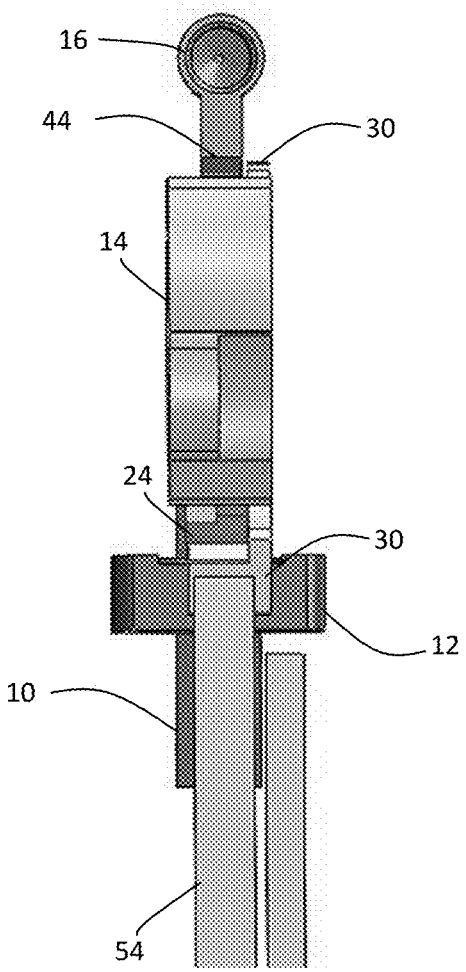
FIG. 14 is a rear view of the sear assembly.

The sear catch 32 is arranged for reciprocating sliding motion in a slot 42 formed in the sear block 18. In drawing FIGS. 1-6, the sear catch 32 may move vertically as it reciprocates in the slot 42. The sear catch 32 extends upward through the slot 42 to engage a lug 44 of the firing pin 16 of the firing pin assembly. The sear catch 32 is connected to the second end 40 of the sear lever 26. As shown in FIG. 5, a hole 46 extends through the sear catch 32. The hole 46 allows a mechanical fastener to extend therethrough to connect the sear catch 32 to the second end 40 of the sear lever 26. As the first end 38 of the sear lever 26 compresses the sear lever spring 28, the second end 40 of the sear lever causes the sear catch 32 to be drawn into the cavity 20 of the sear block 18 thereby retracting the sear catch into the slot 42 and away from the firing pin lug 44.

The disconnector 30 extends across the sear block 18 with a distal portion 48 that engages the trigger bow 12, and a proximal end 50 that projects from the sear block slot. The disconnector 30 has an enlarged center hole 52 that is in register with the sear pivot pivot pin 34. The spacing between edges of the enlarged hole 52 of the disconnector 30 and the sear pivot pivot pin 34 allow the disconnector to reciprocate in the sear block slot 42 and move in a direction transverse to the sear block slot. A disconnector spring 54 may urge the disconnector 30 to extend from the sear block slot 42. The distal portion 48 of the disconnector 30 may have a sear pivot engagement surface 56 and a sear pivot relief area 58. The proximal end 50 of the disconnector 30 may cooperate with a detent of a slide of the firearm. The proximal end 50 of the disconnector 30 may protrude into the detent. The slide may ride over the top of the disconnector proximal end 50 forcing the disconnector 30 against pressure from the disconnector spring 54 to retract through sear block slot 42 during firing of the handgun.

In operation, the trigger 10 moves the trigger bow 12, and the trigger bow 12 causes the disconnector 30 retract into the sear block slot 42 and engage the sear pivot 24. In drawing FIGS. 1-6, leftward motion of the trigger 10 and trigger bow 12 causes downward and leftward motion of the distal end 48 of the disconnector 30. As the disconnector 30 engages the sear pivot 24, the sear pivot cam surface 33 engages the first end 38 of the sear lever 26, compressing the sear lever spring 28 and rotating the sear lever second end 40 in a manner to retract the sear catch 32 into the sear block slot 42. In the drawing figures, the sear pivot 24 rotates clockwise when it is engaged by the disconnector 30, which in turn causes clockwise rotation of the sear lever 26 in the cavity 20 of the sear block 18. As the sear catch 32 retracts into the sear block slot 42, the sear catch 32 disengages from the firing pin lug 44 and actuates the firing pin 16 to discharge a round. As the slide recoils after discharging the round, the disconnector 30 is driven into the sear block slot 42. As the disconnector is driven into the sear block slot 42, the disconnector distal end 48 moves in a manner such that the sear pivot engagement surface 56 no longer engages the sear pivot 24 and the disconnector relief area 58 becomes aligned with the sear pivot. As the disconnector relief area 58 becomes aligned with the sear pivot 24, the sear pivot rotates away from the sear lever first end 38. In drawing FIGS. 1-6, as the disconnetor 30 is driven into the sear block slot 42, the disconnector moves downward to align the disconnector relief area 58 with the sear pivot 24, which in turn allows the sear pivot to rotate counterclockwise and move downward. The sear lever spring 28 causes rotation of the sear lever 26 in the sear block cavity 20 to reposition the sear catch 42 in engagement with the firing pin lug 44. The disconnector spring 54 may allow the disconnector 30 to reposition. In drawing FIGS. 1-6, the disconnector spring 54 urges the disconnector vertically upward in the sear block slot 42 to reposition the disconnector to enable successive firing of the firearm. The disconnector spring 54 may be a flat spring. The sear lever spring 28 may urge the first end 38 of the sear lever against the sear pivot 24. In drawing FIGS. 1-6, when the disconnector relief area 58 is aligned with the sear pivot 24, the sear pivot rotates counterclockwise and downward with the sear lever spring 28 urging the first end 38 of the sear lever against the sear pivot 24.

In view of the foregoing, it will be seen that the several advantages are achieved and attained. The embodiments were chosen and described in order to best explain practical applications to thereby enable others skilled in the art to best utilize the various embodiments and modifications as are suited to a particular use contemplated. As various modifications could be made in the constructions and methods herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. A sear assembly for a firearm, the sear assembly comprising a sear block with a cavity formed therein with a portion of the cavity forming a slot extending through the block, the cavity receiving a sear pivot, a sear lever, a sear catch, and a disconnector, the sear catch being disposed in the slot of the cavity and configured for reciprocating sliding motion in the slot between a first position in which the sear catch engages a firing pin of the firearm and a second position in which the sear catch disengages from the firing pin of the firearm, the sear lever and sear pivot being configured for pivoting motion in the cavity, the sear lever having a first end operatively connected to the sear catch and a second end engagable with the sear pivot with a pivot of the sear lever intermediate the sear lever first and second ends, the disconnector being configured for movement within the cavity and engagable with a slide of the firearm, the disconnector being configured to engage the sear pivot in a manner such that the sear pivot pivots into engagement with the sear lever to move the sear catch from the first position to the second position, the disconnector being configured to disengage from the sear pivot in a manner such that the sear pivot pivots away from the sear lever to move the sear catch from the second position to the first position.

2. The assembly of claim 1 wherein the disconnector has an engagement surface that is configured to engage with the sear pivot to effect movement of the sear catch from the first position to the second position.

3. The assembly of claim 1 wherein the disconnector has a relief area that is configured to disengage from the sear pivot and allow movement of the sear catch from the second position to the first position.

4. The assembly of claim 1 wherein the sear pivot has a cam shape that abuts the sear lever.

5. The assembly of claim 1 wherein the disconnector translates and pivots in the sear block cavity.

6. The assembly of claim 1 further comprising a spring configured to urge the sear lever into contact with the sear pivot.

7. The assembly of claim 6 wherein the spring urges the sear lever to move the sear catch from the second position to the first position.

8. The assembly of claim 6 wherein the spring acts against the sear lever first end.

9. The assembly of claim 1 wherein the disconnector is disposed in the slot.

10. The assembly of claim 1 wherein the slide of the fire arm engages the disconnector to move the disconnector in a manner to disengage the disconnector from the sear pivot and allow movement of the sear catch from the second position to the first position.

11. The assembly of claim 1 wherein the disconnector is configured to interface with a trigger assembly of the firearm.

12. The assembly of claim 1 wherein the disconnector and the sear pivot are configured for pivoting motion in the cavity of the sear block about a common pivot point.

13. The assembly of claim 1 wherein the sear block has an external shape that allows it to be inserted in a frame of a firearm.

14. The assembly of claim 1 wherein the sear assembly comprises a kit configured to allow installation of the sear assembly in the firearm.

15. A method comprising:

removing a pivoting hammer assembly from a frame of a firearm; and installing a sear assembly in the frame of the firearm in an area in the frame of the firearm previously occupied by the pivoting hammer assembly;

wherein the sear assembly comprises a sear block with a cavity formed therein, the cavity is configured to receive a sear pivot, a sear lever, a sear catch, and a disconnector, the sear catch is disposed in a slot of the cavity and configured for reciprocating sliding motion in the slot between a first position in which the sear catch engages a firing pin of the firearm and a second position in which the sear catch disengages from the firing pin of the firearm, the sear lever and sear pivot are configured for pivoting motion in the cavity, the sear lever has a first end operatively connected to the sear catch and a second end engagable with the sear pivot with a pivot of the sear lever intermediate the sear lever first and second ends, the disconnector is configured for movement within the cavity and engagable with a slide of the firearm, the disconnector is configured to engage the sear pivot in a manner such that the sear pivot pivots into engagement with the sear lever to move the sear catch from the first position to the second position, the disconnector is configured to disengage from the sear pivot in a manner such that the sear pivot pivots away from the sear lever to move the sear catch from the second position to the first position.

16. The method of claim 15 further comprising arranging a disconnector spring to urge the disconnector into engagement with the sear pivot.

17. The method of claim 15 further comprising arranging a trigger assembly of the firearm to engage with the disconnector.

18. The method of claim 15 further comprising arranging the slide of the fire arm to engage the disconnector in a manner such that movement of the slide allows movement of the sear catch from the second position to the first position.

19. The method of claim 15 further comprising arranging the firing pin of the firearm to engage with the sear catch when the sear catch is in the first position and to disengage from the sear catch when the sear catch is in the second position.

20. The method of claim 15 wherein the step of installing the sear assembly in the frame of the firearm in an area in the frame of the firearm previously occupied by the pivoting hammer assembly includes installation of the sear assembly in the frame without alteration of the frame.

* * * * *